United States Patent [19]

Yamada et al.

[11] Patent Number: 5,018,367

[45] Date of Patent: May 28, 1991

[54] COOLING ENERGY GENERATOR WITH COOLING ENERGY ACCUMULATOR

[75] Inventors: Akira Yamada; Isao Ohkouchi, both of Hitachi, Japan; Yasuo Koseki, Hitachiota; Hideaki Kurokawa, Hitachi; Katsuya Ebara, Mito; Sankichi Takahashi, Hitachi; Risuke Onoda, Ibaraki; Shigeo Sugimoto, Ushiku, all of Japan

[73] Assignee: Hitachi, Ltd., Tokyo, Japan

[21] Appl. No.: 386,693

[22] Filed: Jul. 31, 1989

[30] Foreign Application Priority Data

Aug. 4, 1988 [JP] Japan ..... 63-195198

[51] Int. Cl.[5] ..... F25B 15/00

[52] U.S. Cl. ..... 62/476; 62/335; 62/434

[58] Field of Search ..... 62/335, 476, 324.4, 62/238.7, 434

[56] References Cited

U.S. PATENT DOCUMENTS

| | | | |
|---|---|---|---|
| 3,852,974 | 12/1974 | Brown | 62/335 X |
| 4,100,755 | 7/1978 | Leonard | 62/476 X |
| 4,285,211 | 8/1981 | Clark | 62/476 X |
| 4,374,468 | 2/1983 | Takeshita et al. | 62/335 X |
| 4,471,630 | 9/1984 | Sugimoto et al. | 62/476 X |
| 4,645,569 | 2/1987 | Akabane et al. | 62/476 X |
| 4,827,735 | 5/1989 | Foley | 62/434 X |
| 4,894,077 | 1/1990 | Simon et al. | 62/434 X |

*Primary Examiner*—Lloyd L. King

*Attorney, Agent, or Firm*—Antonelli, Terry, Stout & Kraus

[57] ABSTRACT

A cooling energy generator with a cooling energy accumulator comprises a refrigerant, absorbent liquid, and a container having a first chamber receiving the absorbent liquid, a second chamber receiving the liquid refrigerant and a vapor passage communicating with a space over the absorbent liquid in the first chamber and with a space over the liquid refrigerant in the second chamber. The absorbent liquid is sprayed in the first chamber, and the absorbent liquid is cooled during an accelerated cooling operation. The absorbent liquid is heated during the cooling energy accumulation operation, and liquid refrigerant is sprayed in the second chamber during the accelerated cooling operation and during the normal cooling operation. An air conditioning heat exchanger supplies the cooling energy to a cooling device for air conditioning, and a heat pump is provided. The cooling energy generator with the cooling energy accumulator continues to generate cooling energy for normal air cooling without any additional device even when the refrigerant is not absorbed by the absorbent because the refrigerant is circulated in the second chamber to generate the normal cooling energy.

4 Claims, 7 Drawing Sheets

COOLING ENERGY GENERATOR WITH COOLING ENERGY ACCUMULATOR

BACKGROUND OF THE INVENTION

The present invention relates to a cooling energy generator for air conditioning and, more particularly, to a cooling energy generator with a cooling energy accumulator effective in decreasing required electric power during the accelerated cooling operation.

In the Japanese Unexamined Patent Publication No. 62-218773, a prior-art cooling energy accumulator is disclosed including four heat exchangers, with two of the heat exchangers being incorporated within a closed circuit of compressing-type heat pump, and the other two heat exchangers of being respectively incorporated within an air-conditioning circuit and a refrigerant-liquefying circuit.

As shown in FIG. 7, when the cooling energy is stored in the accumulator, a heat-pump refrigerant gas (for example, Freon gas) is compressed by a compressor 1 so that the temperature of heat-pump refrigerant gas is increased. The compressed high-temperature heat-pump refrigerant gas flows in a first heat exchanger 4 in a closed container 23 to heat an absorbent sprayed on the outer surface of the first heat exchanger 4. The absorbent includes a refrigerant. The refrigerant evaporates from the absorbent heated on the outer surface of the first heat exchanger 4, so that the absorbent is concentrated. The concentrated absorbent is stored in a bottom of a first chamber. The heat-pump refrigerant gas cooled by the evaporating refrigerant condenses and liquefies in the first heat exchanger 4. The heat-pump refrigerant subsequently passes through an orifice 18 for adiabatic expansion so that the temperature of heat-pump refrigerant is decreased. The cool heat-pump refrigerant flows into a second heat exchanger 5, and the refrigerant vapor generated on the first heat exchanger 4 flows through a vapor passage 25 into a second chamber in which the second heat exchanger 5 is arranged. The refrigerant vapor condenses and liquefies on the cool outer surface of the second heat exchanger 5. The liquefied refrigerant is stored in the bottom of the second chamber.

When the cooling energy accumulator generates cooling energy, the accumulator operates as follows. At first stage, heat exchangers 26 and 27 arranged in the container 23 are used, but the heat exchangers 4 and 5 are not used at this stage. The concentrated absorbent stored in the bottom of the first chamber is sprayed on the outer surface of the heat exchanger 26 from a spray device 30. A cooling liquid flows in the heat exchanger 26 so that the absorbent is cooled by the heat exchanger 26 and absorbs the refrigerant vapor. Since the refrigerant vapor is absorbed by the absorbent, the pressure in the container 23 decreases. The refrigerant stored in the bottom of the second chamber is sprayed on the outer surface of the heat exchanger 27 from a spray device 31. The sprayed refrigerant evaporates at the saturation temperature corresponding to the pressure existing in the container 23. When the refrigerant evaporated, the refrigerant absorbs a latent heat. The cooling liquid flowing in the heat exchanger 27 is cooled by the latent heat and the cooling liquid is used for air conditioning. The refrigerant vapor absorbing the latent heat is absorbed by the absorbent, so that the concentration of the absorbent decreases. When the concentration of absorbent decreases under a certain level, the absorptivity of absorbent for absorbing the refrigerant vapor decreases, so that the pressure in container increases. The increase of pressure in the container makes the evaporation of refrigerant for generating the cooling energy insufficient. Therefore, in second stage, the heat pump is operated as follows. The compressed high-temperature and high-pressure heat-pump refrigerant flows in the direction opposite to the direction described above. The compressed high-temperature and high-pressure heat-pump refrigerant is cooled in a radiator 6 and subsequently passes through the orifice 18 for adiabatic expansion so that the temperature of heat-pump refrigerant further decreases. Then, the cooled heat-pump refrigerant flows into the heat exchanger 4. Therefore, the refrigerant vapor is condensed and liquefied on the heat exchanger 4. Since the pressure in the container 23 is decreased with the condensation of refrigerant vapor, the evaporation of refrigerant liquid sprayed on the heat exchanger 27 becomes possible again, so that the air conditioning can be continued.

OBJECT AND SUMMARY OF THE INVENTION

The object of the present invention is to provide a cooling energy generator with a cooling energy accumulator having a small size and a simple structure.

The cooling energy generator with the cooling energy accumulator according to the present invention. includes a refrigerant which absorbs a latent heat when the refrigerant evaporates, and an absorbent liquid which includes and absorbs the refrigerant therein. A container is provided having a first chamber for receiving the absorbent liquid, a second chamber for receiving the liquid refrigerant and a vapor passage communicating with a space over the absorbent liquid in the first chamber and with a space over the liquid refrigerant in the second chamber so that the refrigerant vapor passes through the vapor passage but the absorbent liquid and the liquid refrigerant cannot pass through the vapor passage. A spraying means sprays the absorbent liquid in the first chamber, with absorbent cooling means being provided for cooling the absorbent liquid during the accelerated cooling operation. Absorbent heating means heat the absorbent liquid during the cooling energy accumulating operation, and refrigerant spraying means spray the liquid refrigerant in the second chamber during the accelerated cooling operation and during normal cooling operation. An air conditioning heat exchanger is arranged under the refrigerant spraying means, with the air-conditioning heat exchanger supplying the cooling energy to a cooling device for air conditioning. A heat pump means is provided having a compressor for compressing heat-pump refrigerant, a heat-pump radiator for cooling the compressed high-temperature heat-pump refrigerant, an orifice for adiabatic expansion of the compressed and cooled heat-pump refrigerant and a heat-pump heat exchanger in which the low-temperature heat pump refrigerant passes, with the heat pump heat exchanger being arranged between the vapor passage and the refrigerant spraying means in the second chamber.

During the cooling energy accumulating operation, the absorbent liquid including the refrigerant is heated by the absorbent heating means and sprayed by the absorbent spraying means in the first chamber. From the heated and sprayed absorbent liquid, the refrigerant evaporates. The vapor of refrigerant flows through the vapor passage to the second chamber. In the second chamber, the refrigerant vapor is cooled by the heat-pump heat exchanger, so that the refrigerant vapor changes to the refrigerant liquid. The refrigerant liquid is received in the second chamber.

During the normal cooling operation, the refrigerant liquid received in the second chamber is sprayed by the refrigerant spraying means on the air-conditioning heat exchanger which is arranged under the refrigerant spraying means and which supplies the cooling energy to a cooling device for air conditioning. The sprayed refrigerant liquid is heated on the air-conditioning heat exchanger by the energy transferred from the cooling device. Therefore, the refrigerant liquid evaporates and absorbs a latent heat from the air-conditioning heat exchanger, so that the air-conditioning heat exchanger is cooled to supply the cooling energy to the cooling device for air conditioning. The refrigerant vapor generated on the air-conditioning heat exchanger is subsequently cooled by the heat-pump heat exchanger arranged between the vapor passage and the refrigerant spraying means in the second chamber so that the refrigerant vapor liquefies and the liquefied refrigerant is received in the second chamber again. As described above, for the normal cooling operation, the refrigerant is circulated in the second chamber.

During the accelerated cooling operation, in addition to the normal cooling operation of cooling energy generator as described above, the absorbent sprayed by the absorbent spraying means in the first chamber is cooled by the absorbent cooling means. The cooled absorbent absorbs the refrigerant vapor which flows through the vapor passage from the second chamber to the first chamber. Since the refrigerant vapor is absorbed by the absorbent, the pressure in the container is decreased, so that the evaporation of the refrigerant liquid sprayed on the air-conditioning heat exchanger is accelerated. Therefore, the cooling energy supplied by the air-conditioning heat exchanger for air conditioning is increased for the accelerated cooling operation.

The prior-art cooling system as shown in FIG. 7 must have additional devices for the normal cooling operation, because the described prior-art cooling system without the additional devices can not continue to generate the cooling energy when the absorbent does not continue to absorb the refrigerant. On the other hand, the cooling energy generator with the cooling energy accumulator according to the present invention can continue to generate the cooling energy for the normal air cooling without any additional device even when the refrigerant is not absorbed by the absorbent, because the refrigerant is circulated in the second chamber to generate the normal cooling energy.

DETAILED DESCRIPTION OF PREFERRED EMBODIMENTS

Figure 1:
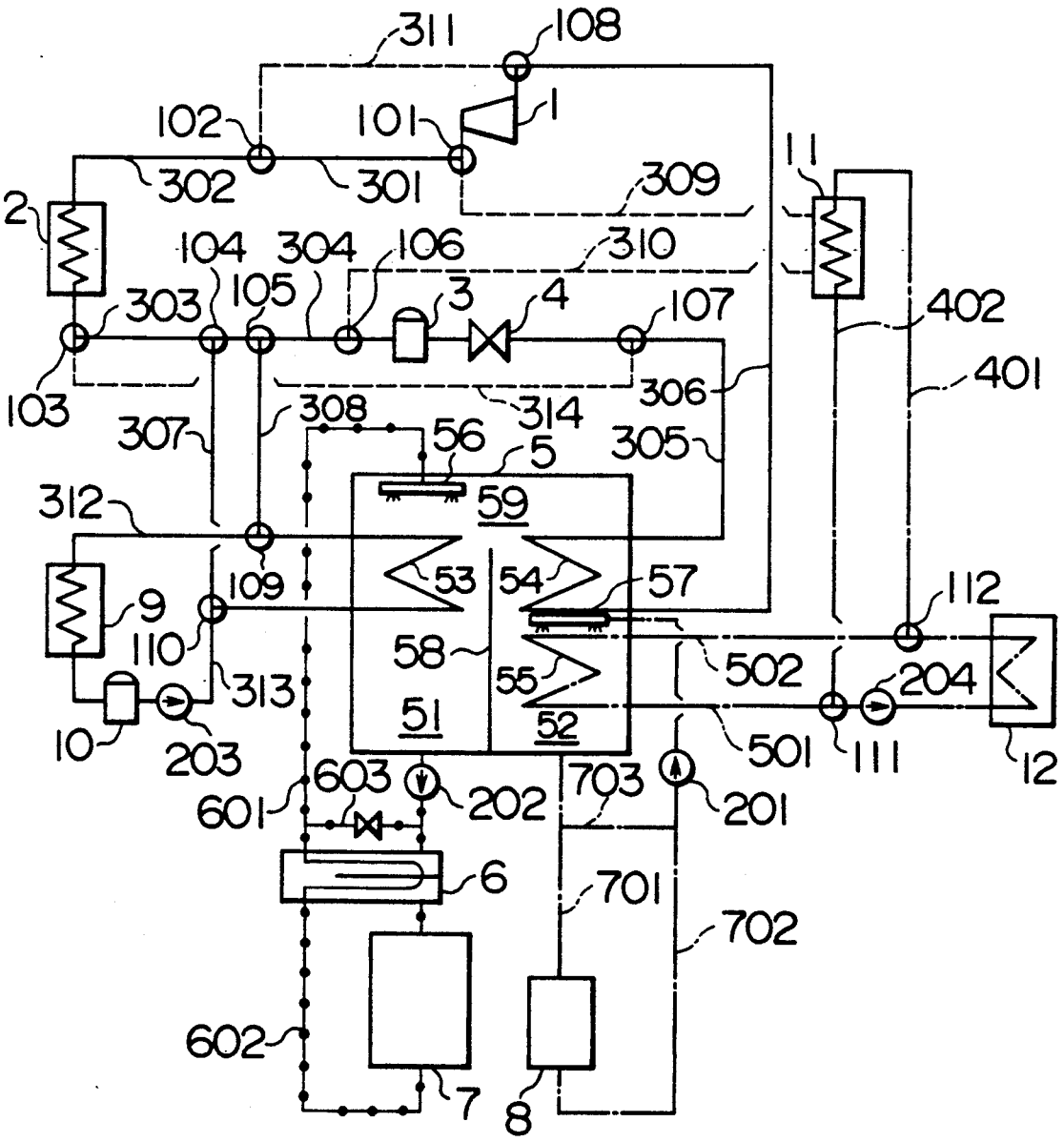
FIG. 1 is a schematic diagram showing constituent parts and pipeline of an embodiment of the present invention.
Figure 2:
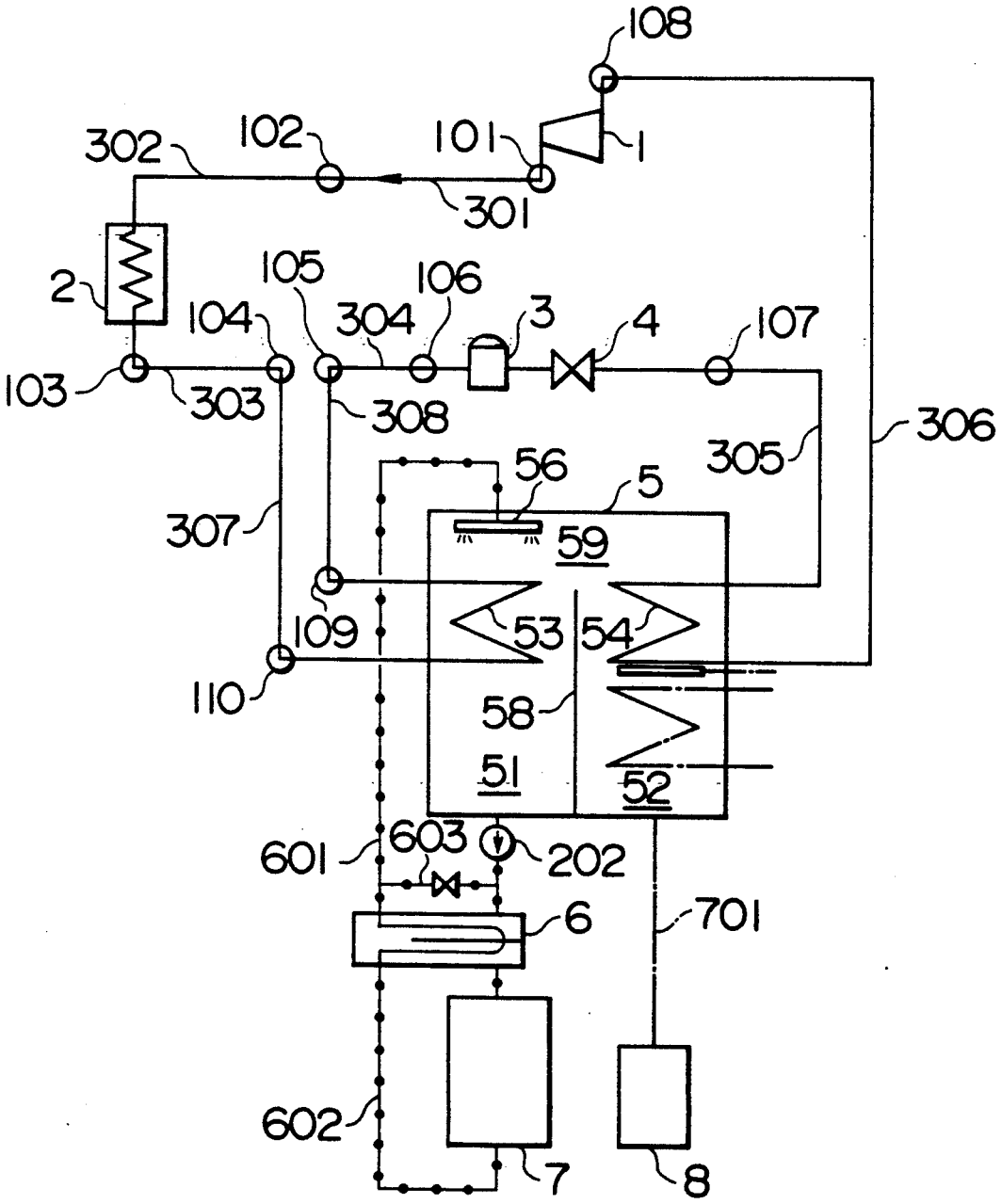
FIG. 2 is a schematic diagram showing the constituent parts and pipeline used in the cooling energy accumulating operation of the embodiment shown in FIG. 1.

In the embodiment shown in FIG. 1, refrigerant of a compressing-type heat pump circuit is Freon, the refrigerant for accumulating cooling energy is water, and absorbent liquid is lithium bromide.

The compressing-type heat pump circuit has a compressor 1, a second air-cooled radiator 2 connected to an outlet of the compressor 1 through pipes 301 and 302, an adiabatic expansion chamber 3 connected to the second air-cooled radiator 2 through pipes 303 and 304, an adiabatic expansion orifice 4 connected to the adiabatic expansion chamber 3, and a second heat exchanger 54 connected to the outlet of the adiabatic expansion orifice 4 through a pipe 305 and connected to an inlet of the compressor 1 through a pipe 306. A three-way directional control valve 102 is arranged between the pipes 301 and 302. A three-way directional control valve 108 is arranged in the pipe 306 between the compressor 1 and the second heat exchanger 54. The three-way directional control valves 102 and 108 are connected to each other through a pipe 311. A three-way directional control valve 103 is arranged in the pipe 303 adjacent to the second air-cooled radiator 2. A three-way directional control valve 104 is arranged in the pipe 303 between the three-way directional control valve 103 and the pipe 304. A three-way directional control valve 106 is arranged in the pipe 304 adjacent to the adiabatic expansion chamber 3. A three-way directional control valve 105 is arranged in the pipe 304 between the three-way directional control valve 106 and the pipe 303. A three-way directional control valve 107 is arranged in the pipe 305. The three-way directional control valve 107 is connected to the three-way directional control valve 103 through a pipe 314. A heating system heat exchanger 11 has a heating circuit and a heated circuit for supplying heated liquid. The heating circuit is connected to the three-way directional control valve 101 through a pipe 309 and to the three-way directional control valve 106 through a pipe 310 so that the compressed refrigerant of the heat pump circuit is supplied to the heating circuit.

A container 5 is divided by a wall 58 into a first chamber 51 including a first heat exchanger 53 and a second chamber 52 including the second heat exchanger 54 and a third heat exchanger 55. A vapor passage communicates with the first chamber 51 and with the second chamber 52. An outlet of the first heat exchanger 53 is connected to an inlet of a first air-cooled radiator 9 through a pipe 312. A three-way directional control valve 109 is arranged in the pipe 312 between the first heat exchanger 53 and the first air-cooled radiator 9 . An outlet of the first air-cooled radiator 9 is connected to an inlet of the first heat exchanger 53 through a pipe 313. An expansion tank 10 and a pump 203 are arranged in the pipe 313 between the first air-cooled radiator 9 and the first heat exchanger 53. The first chamber 51 is connected to an inlet of a pump 202. An outlet of the pump 202 is connected to a heated liquid recovery inlet of a heat recovery device 6 and is also connected to a pipe 601 through a pipe 603. The pipe 601 communicates with an liquid-heat recovery outlet of the heat recovery device 6 and with an absorbent spraying device 56 for spraying the absorbent liquid on the surface of the first heat exchanger 53. A valve is arranged in the pipe 603 between the pump 202 and the pipe 601. A heated liquid recovery outlet of the heat recovery device 6 is connected to an upper portion of an absorbent reservoir 7. A bottom part of the absorbent reservoir 6 is connected to the liquid-heat recovery outlet of the heat recovery device 6 through a pipe 602. A bottom part of the second chamber 52 is connected to an upper part of a refrigerant reservoir 8 through a pipe 701. A bottom part of the refrigerant reservoir 8 is connected through a pipe 702 to a refrigerant spraying device 57 for spraying the refrigerant on a surface of the third heat exchanger 55. The pipe 702 has a pump 201 to transfer the refrigerant from the refrigerant reservoir 8 onto the surface of the third heat exchanger 55. The pipes 701 and 702 are connected to each other through a pipe 703. A heat-transfer medium outlet of an indoor unit 12 operating as a radiator is connected to an inlet of the third heat exchanger 55 through a pipe 502 having a three-way directional control valve 112. An outlet of the third heat exchanger 55 is connected to a heat-transfer medium inlet of the indoor unit 12 through a pipe 501 which has a three-way directional control valve 111 and a pump 204. A heat liquid inlet of the heating system heat exchanger 11 is connected to the three-way directional control valve 112 through a pipe 401. A heated liquid outlet of the heating system heat exchanger 11 is connected to the three-way directional control valve 111 through a pipe 402. The three-way directional control valve 105 is connected to the three-way directional control valve 109 through a pipe 308. The three-way directional control valve 104 is connected to the three-way directional control valve 110 through a pipe 307.

During the cooling energy accumulating operation the high-pressure and high-temperature Fleon vapor compressed by the compressor 1 flows to the second air-cooled radiator 2 through the pipes 301 and 302 and is cooled by the air surrounding the second air-cooled radiator 2 so that the vapor changes to the saturated gas or to the wet gas. The cooled Fleon gas flows subsequently to the first heat exchanger 53 through the pipe 307. The lithium bromide aqueous solution flows from the absorbent reservoir 7 to the absorbent spraying device 56 through the pipe 602, the heat recovery device 6 and the pipe 601. The absorbent spraying device 56 sprays the lithium bromide aqueous solution on the first heat exchanger 53. The sprayed lithium bromide aqueous solution is received in the bottom of the first chamber 51. A part of the lithium bromide aqueous solution is circulated again through the pipe 603 by the pump 202. Another part of the lithium bromide aqueous solution flows to the absorbent reservoir 7 through the heat recovery device 6. The lithium bromide aqueous solution sprayed on the first heat exchanger 53 is heated by the high-pressure and high-temperature Fleon vapor flowing in the first heat exchanger 53. The temperature of the Fleon vapor supplying heat to the lithium bromide aqueous solution decreases in the first heat exchanger 53, so that the Fleon vapor changes to the fleon liquid. The Fleon liquid flows to the adiabatic expansion orifice 4 through the pipes 308 and 304 and the adiabatic expansion chamber 3. The Fleon liquid expands adiabatically at the adiabatic expansion orifice 4 and the temperature of the Fleon liquid further decreases.

The water evaporates from the lithium bromide aqueous solution, that is, absorbent heated on the first heat exchanger 53. In this embodiment, since the absorbent spraying device 56 is arranged at the most upper position in the first chamber 51, the period of time for evaporating the water from the lithium bromide aqueous solution flowing downward is increased. The generated vapor flows to the second heat exchanger 54 through the vapor passage.

The low-temperature fleon liquid cooled at the adiabatic expansion orifice 4 flows to the second heat exchanger 54 through the pipe 305 so that the water vapor generated on the surface of the first heat exchanger 53 is cooled and condensed on the surface of the second heat exchanger 54. The fleon liquid is heated and evaporated by the latent heat of the condensed water. The evaporated fleon flows to the compressor 1 through the pipe 306 to be compressed again. The compressed high-temperature fleon vapor circulates in the above circuit.

In the above operation, the refrigerant for accumulating cooling energy is separated from the absorbent and is received in bottom of the second chamber 52. A part of the condensed absorbent having high-concentration of the lithium bromide is transferred to the absorbent reservoir 7 by the pump 202 through the heat recovery device 6. The other part of the condensed absorbent is mixed with the low-concentration absorbent flowing from the absorbent reservoir 7 through the pipe 603. The mixed absorbent flows again to the spraying device 56 through the pipe 601.

In the heat recovery device 6, the high-concentration absorbent flowing from the pump 202 is cooled by the low-concentration absorbent flowing from the absorbent reservoir 7 so that the absorbent flowing toward the spraying device 56 is preheated. If the first chamber has sufficient size for storing all the absorbent, the absorbent reservoir 7 may be eliminated.

The water (refrigerant) cooled and liquefied on the surface of the second heat exchanger 54 is stored in the refrigerant reservoir 8 through the pipe 701.

The maximum concentration of lithium bromide of the absorbent is determined by the temperature of the first heat exchanger 53 of the heat source and by the temperature of the second heat exchanger 54 of the cooling source.

When the maximum-concentration absorbent is received in the absorbent reservoir 7 and the maximum refrigerant for accumulating the cooling energy is received in the refrigerant reservoir 8, the cooling energy operation is finished.

During the normal cooling operation, the high-temperature super heated Fleon vapor compressed by the compressor 1 flows to the second air-cooled radiator 2 through the pipes 301 and 302, and is cooled in the second air-cooled radiator 2 by the air, so that the Fleon vapor changes to saturated liquid. The saturated liquid flows to the adiabatic expansion orifice 4 through the pipes 303 and 304 and the adiabatic expansion chamber 3 so that the saturated Fleon liquid expands adiabatically to change to the low-temperature fleon liquid. The low-temperature Fleon liquid subsequently flows to the second heat exchanger 54. In the pipeline of the indoor unit 12, the pipes 501 and 502 and the third heat exchanger 55, the water is circulated by the pump 204. The refrigerant water stored in the refrigerant reservoir 8 is transferred to the refrigerant spraying device 57 through the pipe 702 by the pump 201 and is sprayed from the refrigerant spraying device 57 on the surface of the third heat exchanger 55 arranged under the refrigerant spraying device 57. The water heated by the temperature of the outer surface of the indoor unit 12 flows into the third heat exchanger 55 through the pipe 502 and heats the refrigerant water sprayed on the surface of the third heat exchanger 55 so that the refrigerant water evaporates thereon. When the refrigerant water evaporates on the surface of the third heat exchanger 55, the refrigerant water absorbs the latent heat so that the water flowing in the third heat exchanger 55 is cooled. The cooled water flows to the indoor unit 12 so that the air surrounding the indoor unit 12 is cooled.

The vapor generated on the surface of the third heat exchanger 55 is cooled and liquefied on the surface of the second heat exchanger 54 which is arranged between the vapor passage and the refrigerant spraying device 57 and in which the low-temperature Fleon liquid flows to cool the refrigerant vapor. The liquefied water is received in the bottom of the second chamber 52 and subsequently flows to the refrigerant reservoir 8. If the second chamber 52 has sufficient size for storing all the refrigerant, the refrigerant reservoir 8 may be eliminated. In this embodiment since the second heat exchanger 54 is arranged at a level lower than that of the vapor passage and between the vapor passage and the refrigerant spraying device 57, it is difficult for the high-temperature refrigerant vapor flowing upward to flow to the first chamber 51 through the vapor passage. As described above, during the normal cooling operation, the refrigerant is circulated in the second chamber 52. During the normal cooling operation, the operations of the first heat exchanger 53 and the absorbent spraying device 56 are stopped.

Figure 3:
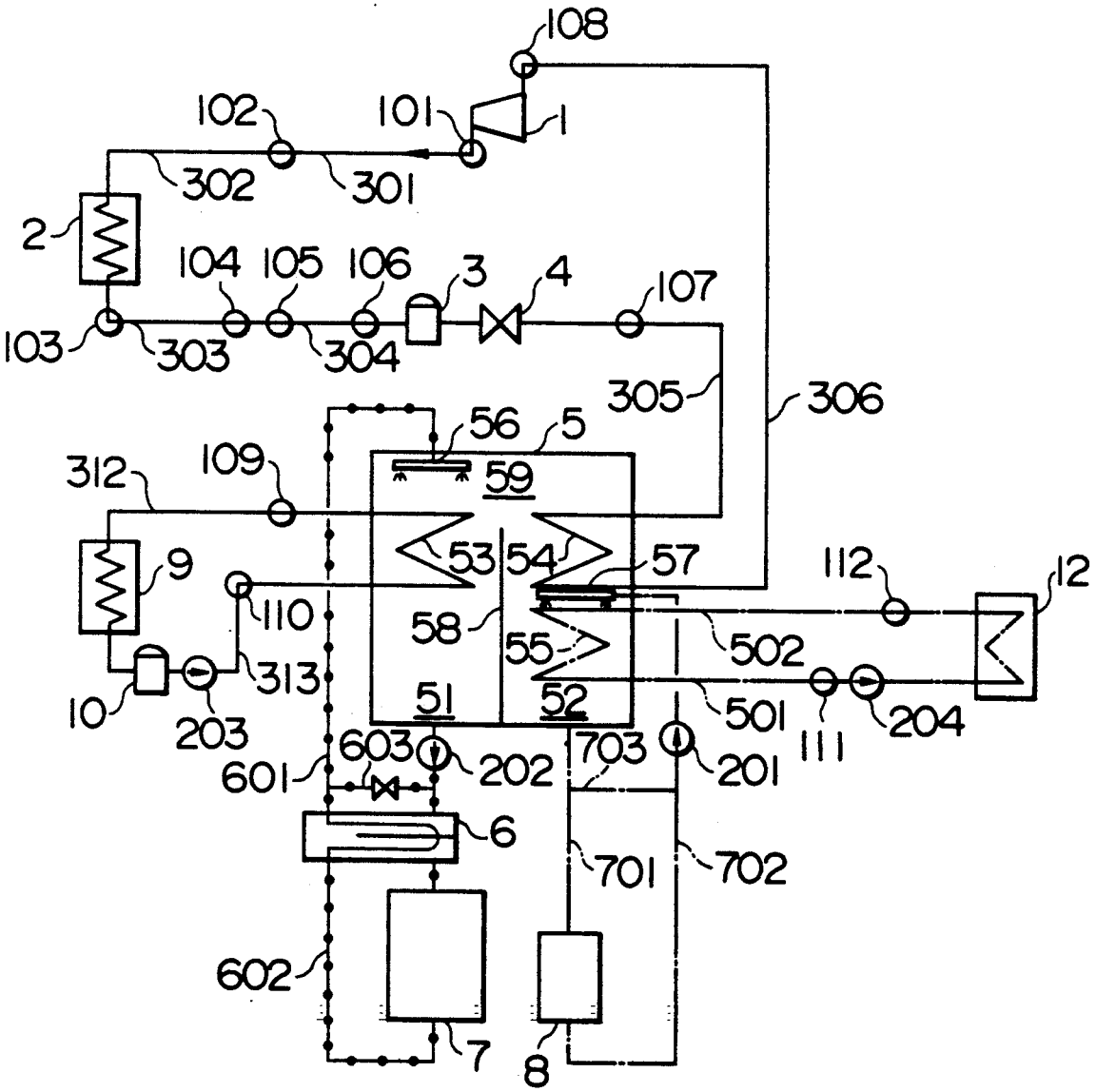
FIG. 3 is a schematic diagram showing constituent parts and pipeline used in the cooling operation of the embodiment shown in FIG. 1.

During the accelerated cooling operation, the high-concentration absorbent supplied from the absorbent reservoir 7 is sprayed on the first heat exchanger 53 by the absorbent spraying device 56. The first heat exchanger 53 is connected to the first air-cooled radiator 9 through the pipes 312 and 313, the adiabatic tank 10 and the pump 203 which circulates the Fleon refrigerant to cool the first heat exchanger 53. (Since the Fleon refrigerant of the heat pump flows in the first heat exchanger 53 during the cooling energy accumulating operation, the Fleon refrigerant remains in the first heat exchanger 53 when the cooling energy accumulating operation is finished and the three-way directional control valves operate to disconnect the first heat exchanger 53 from the second air-cooled radiator 2 and to connect the first heat exchanger 53 with the first air-cooled radiator 9 as shown in FIG. 3.)

The refrigerant vapor generated on the surface of the third heat exchanger 55 flows into the first chamber 51 through the vapor passage 59. The refrigerant vapor is absorbed by the absorbent sprayed by the absorbent spraying device 56, so that the refrigerant is liquefied and the absorbent is heated by the latent heat of the liquefied refrigerant. The heated absorbent is sprayed on the surface of the first heat exchanger 53 and is cooled by the Fleon refrigerant flowing in the first heat exchanger 53. The Fleon refrigerant heated by cooling the absorbent changes to the saturated vapor. The saturated vapor of the Fleon refrigerant is circulated by the pump 203 to be cooled by the first air-cooled radiator 9 and to be further cooled through the adiabatic expansion at the adiabatic tank 10, so that the saturated vapor changes to the saturated liquid. The saturated liquid of the fleon refrigerant flows to the first heat exchanger 53 through the pipe 203. A part of the cooled low concentration absorbent is transferred by the pump 202 to the absorbent reservoir 7, and the other part of the cooled low-concentration absorbent is mixed through the pipe 603 with the high-concentration absorbent stored in the absorbent reservoir 7 and is transferred to the absorbent spraying device 56.

Since the refrigerant vapor is absorbed by the absorbent, the pressure in the second chamber 52 decreases, so that the evaporation of the refrigerant sprayed on the surface of the third heat exchanger 55 is accelerated. Therefore, the cooling energy supplied to the indoor unit is increased.

When the concentration of the absorbent decreases below a certain degree or when the amount of refrigerant absorbed by the absorbent is more than a certain degree, the accelerated cooling operation can not be continued. Therefore, the control method for controlling the accelerated cooling operation is required.

Figure 4:
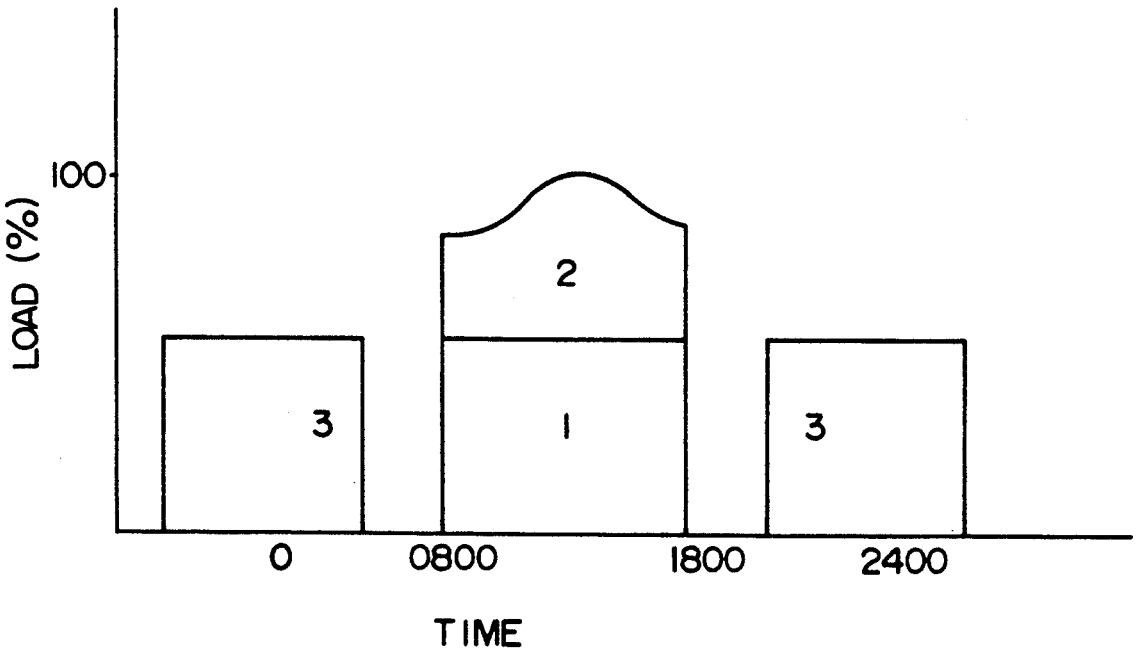
FIG. 4 is a graph of cooling load against time.
Figure 5:
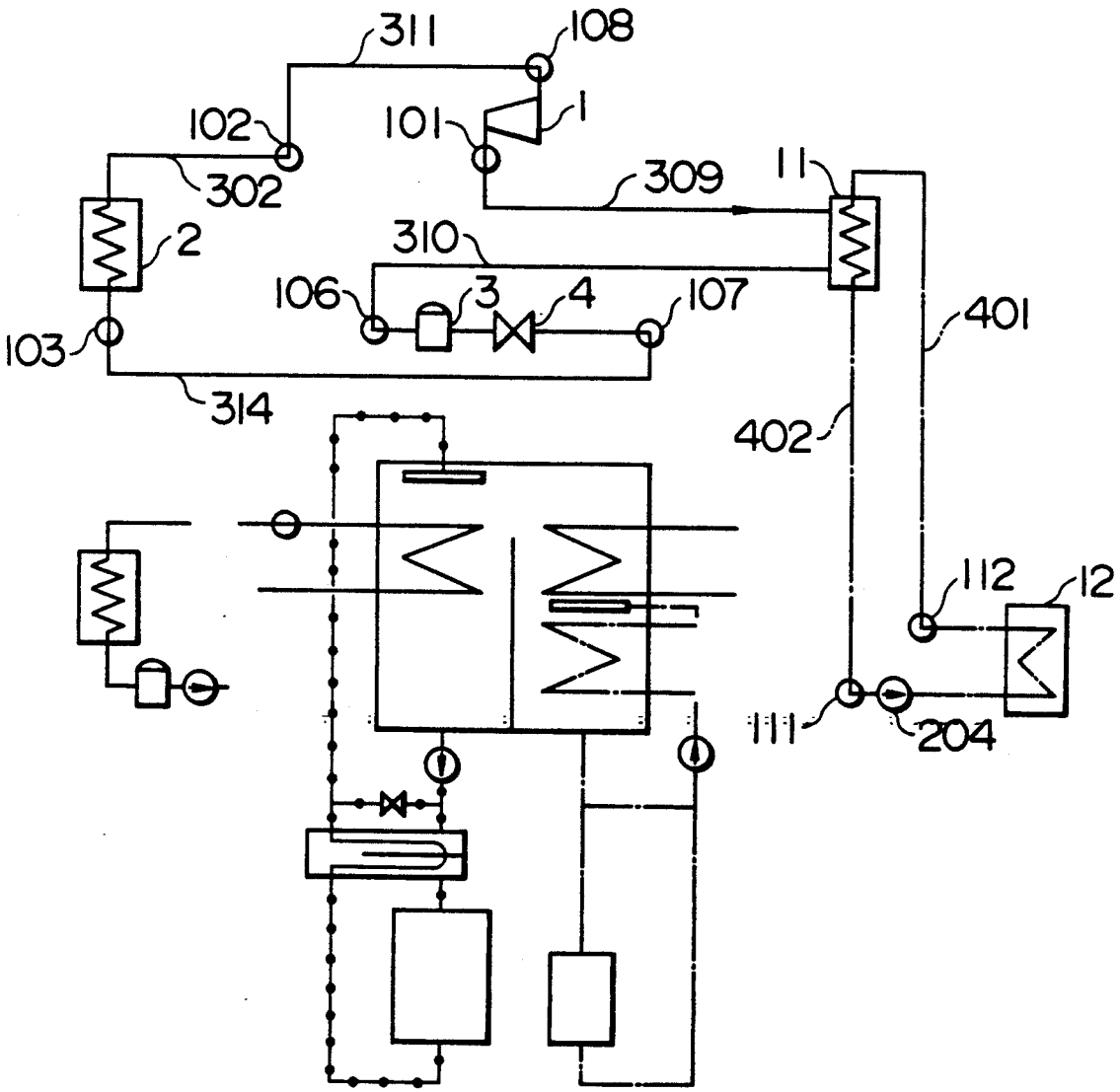
FIG. 5 is a schematic diagram showing constituent parts and pipeline used in the heating operation of the embodiment shown in FIG. 1.

FIG. 4 shows an example of the relation between the cooling load and the time in a summer day. In this example, the cooling operation starts at 0800 hrs. o'clock and stops at 1800 o'clock. The maximum cooling load occurs usually between 1200 hrs. and 1500 hrs. If the cooling device do not have a cooling energy accumulator, the heat pump must generate the cooling energy corresponding to the maximum cooling load, so that the size of the cooling device and the cost for operating the cooling device must be large. In the cooling energy generator with the cooling energy accumulator according to the present invention, the cooling energy is accumulated during the night when the cost of electric power is small. That is, the cooling energy indicated by the area 2 is accumulated in the cooling energy accumulator during the cooling energy accumulating operation indicated by the area 3. Therefore, the cooling capacity of the cooling energy generator may be a half of that of the prior art cooling energy generator.

In the control method for controlling the cooling energy generator with the cooling energy accumulator according to the present invention, at first, the above mentioned normal cooling operation is started. If the cooling load or the heat energy supplied from the indoor unit 12 to the third heat exchanger 55 becomes more than the capability of the heat-pump, the speed of liquefying the refrigerant vapor on the second heat exchanger 54 becomes less than the speed of producing the refrigerant vapor on the third heat exchanger 55, so that the pressure in the second chamber 52 increases. The speed of evaporation of the refrigerant on the third heat exchanger 55 is decreased by the increase of pressure in the second chamber 52, so that the cooling energy generated on the third heat exchanger 55 is decreased. When the cooling energy decreases, a difference in medium temperature between the inlet and outlet of the third heat exchanger 55 decreases, so that the medium temperature at the outlet of the third heat exchanger 55 becomes more than a predetermined degree. In this operation method, the medium temperature at the outlet of the third heat exchanger 55 and/or the pressure in the second chamber 52 are measured and the operation of the absorbent spraying device for spraying the absorbent on the first heat exchanger 53 is controlled in accordance with the differences between the measured temperature and/or pressure and the predetermined degree so that the refrigerant is absorbed by the absorbent and the pressure in the second chamber 52 less than the predetermined degree is maintained.

Therefore, the accelerated cooling energy generating operation is carried out.

Figure 6:
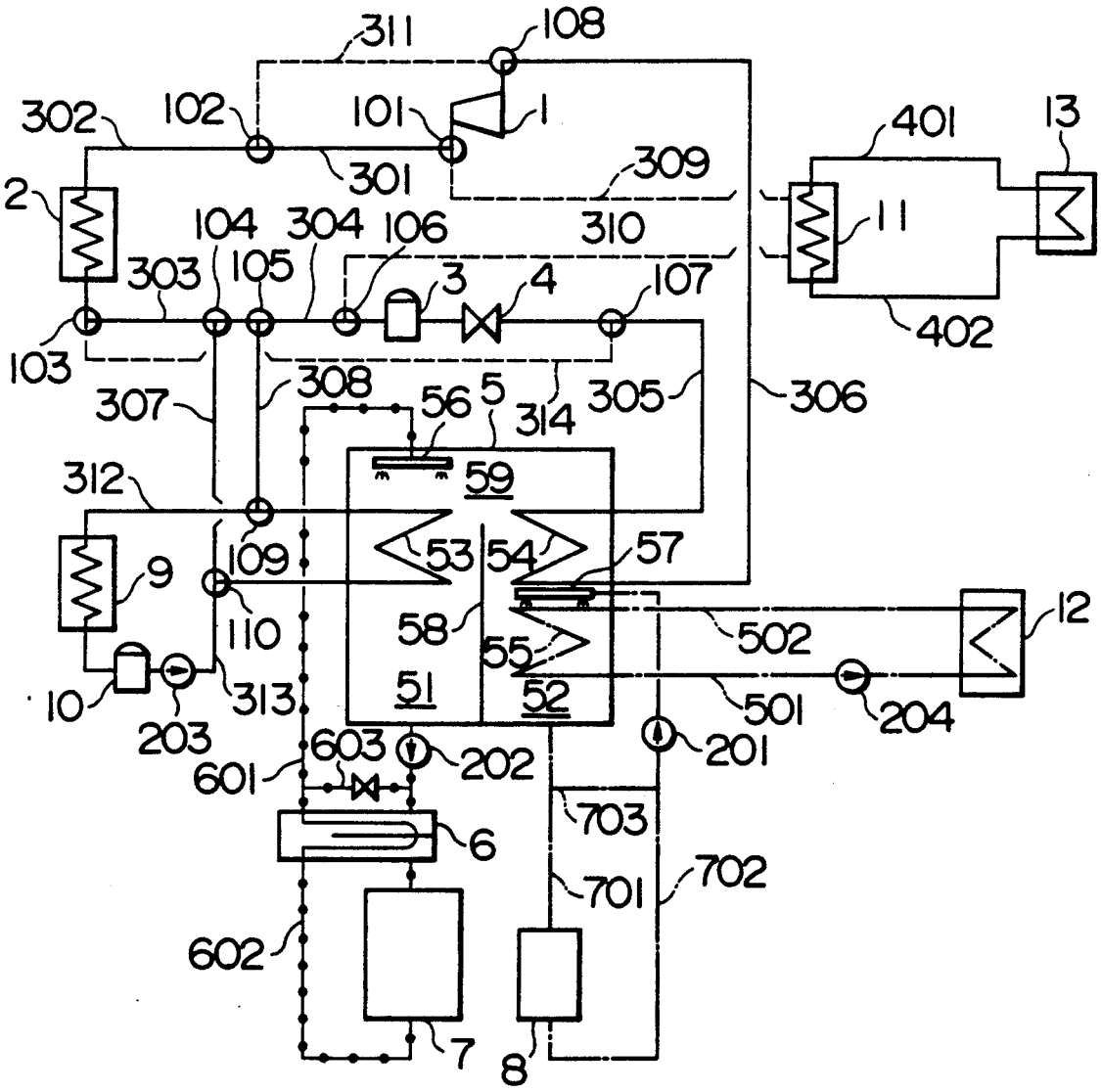
FIG. 6 is a schematic diagram showing constituent parts and pipeline of another embodiment of the present invention.
Figure 7:
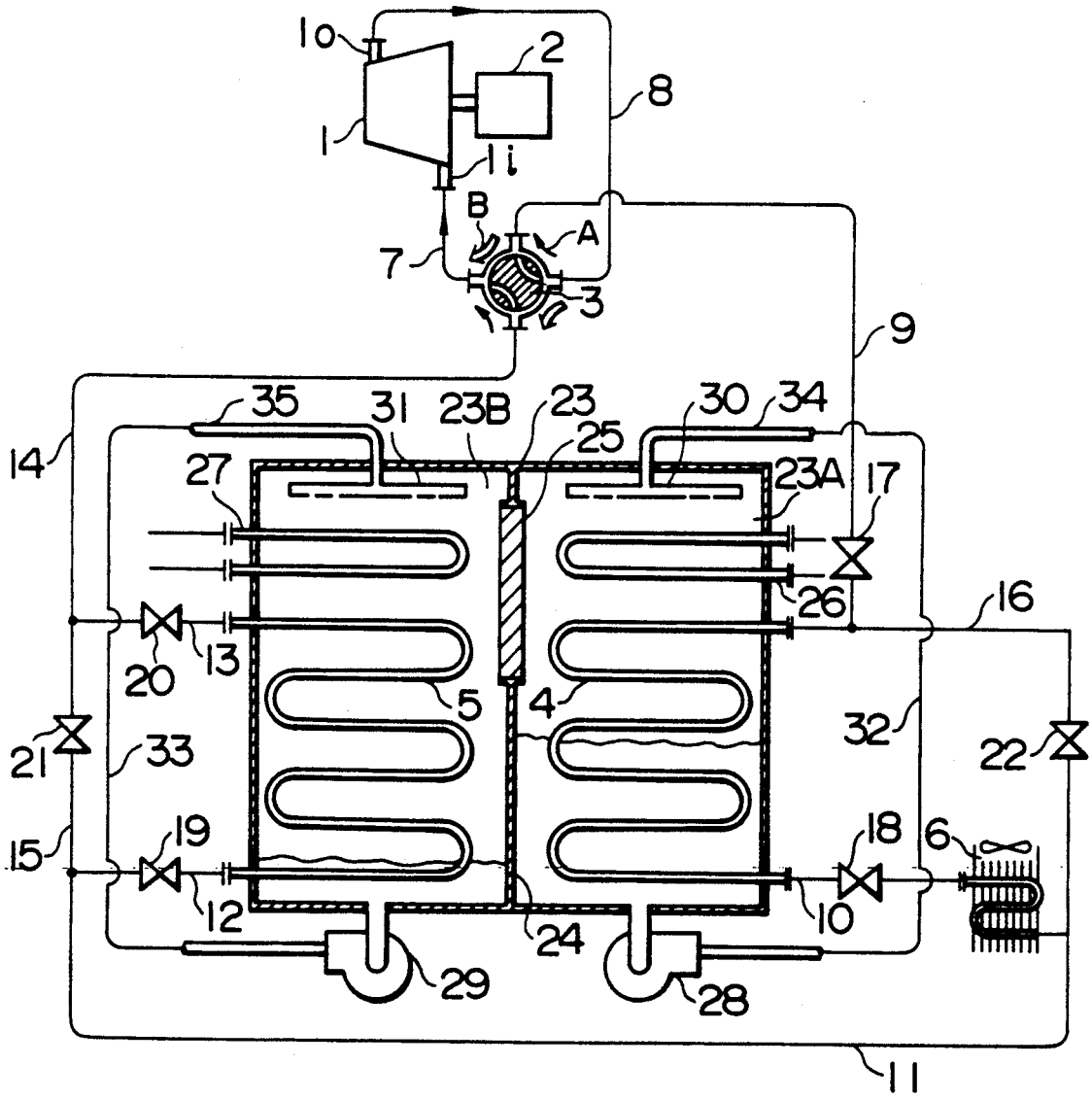
FIG. 7 is a schematic diagram showing constituent parts and pipeline of a conventional coolingenergy accumulator.

The superheated high-temperature Fleon vapor compressed by the compressor 1 flows into the heat exchanger for heating purposes 11 through the pipe 309. The heat exchanger for heating purposes 11 is connected to the indoor unit 12 through the pipes 401 and 402 to form a heating closed-circuit. In the heating closed-circuit, a harmless heating medium such as water is circulated by the pump 204. The superheated high-temperature Fleon vapor heats the heating medium in the heat exchanger for heating purposes 11. The heated heating medium heats the air surrounding the indoor unit 12 and the heating medium cooled in the indoor unit 12 is heated again in the heat exchanger for heating purposes 11. After the super heated high-temperature Fleon vapor heats the heating medium in the heat exchanger for heating purposes 11, the Fleon vapor changes to the Fleon liquid. The Fleon liquid flows through the pipe 310 and the expansion chamber 3 to the adiabatic expansion orifice 4 at which the Fleon liquid expands adiabatically and changes to the low-temperature Fleon liquid. The low-temperature fleon liquid flows through the pipe 310 to the second air-cooled radiator 2 at which the low-temperature fleon liquid absorbs the heat from the air surrounding the second air-cooled radiator 2 and changes to the saturated vapor or to the nearly saturated wet vapor. The saturated vapor or to the nearly saturated wet vapor flows through the pipes 302 and 311 to the compressor 1 and changes to the superheated high-temperature Fleon vapor. Since the heating energy is supplied to the indoor unit 12 through the heat exchanger for heating purposes 11 and the heating medium such as water flowing in the indoor unit 12 is harmless, the safety of the heating device can be provided. The indoor unit 12 is used as a cooling unit and as a heating unit in this embodiment. But, the cooling and heating indoor units separated from each other may be employed. The indoor unit 12 may have both of a heat exchanging coil and a cooling exchanging coil separated from each other. FIG. 6 shows the pipeline and constituent parts of the other embodiment having the cooling indoor unit 12 and a heating indoor unit 13.

What is claimed is:

1. A cooling energy generator with a cooling energy accumulator, comprising:

refrigerant which absorbs a latent heat when the refrigerant evaporates, absorbent liquid which includes and absorbs the refrigerant therein, a container having a first chamber receiving the absorbent liquid, a second chamber receiving the liquid refrigerant and a vapor passage communicating with the space over the absorbent liquid in the first chamber and with a space over the liquid refrigerant in the second chamber so that the refrigerant vapor passes through the vapor passage but the absorbent liquid and the liquid refrigerant can not pass through the vapor passage, absorbent spraying means for spraying the absorbent liquid in the first chamber, means for cooling the absorbent liquid during the accelerated cooling operation and for heating the absorbent liquid during a cooling energy accumulating operation, refrigerant spraying means for spraying the liquid refrigerant in the second chamber during the accelerated cooling operation and during a normal cooling operation, air-conditioning heat exchanger arranged under the refrigerant spraying means, the air-conditioning heat exchanger supplying cooling energy to a cooling device for air conditioning, and heat pump means having a compressor for compressing heat-pump refrigerant, a heat-pump radiator for cooling the compressed high-temperature heat-pump refrigerant, an orifice for adiabatic expansion of the compressed and cooled heat-pump refrigerant and a heat-pump heat exchanger in which the low-temperature heat-pump refrigerant passes, the heat-pump heat exchanger arranged between the vapor passage and the refrigerant spraying means in the second chamber.

2. A cooling energy generator with a cooling energy accumulator according to claim 1, wherein a heating energy of the means for heating the absorbent liquid is supplied from the compressed high-temperature heat-pump refrigerant between the compressor and the orifice.

3. A cooling energy generator with a cooling energy accumulator according to claim 1, wherein the absorbent spraying means is arranged at a highest portion of the first chamber.

4. A cooling energy generator with a cooling energy accumulator according to claim 1, wherein the heat-pump heat exchanger is arranged at a level lower than a level of the vapor passage.

* * * * *